United States Patent [19]

Bianchi

[11] 4,437,722

[45] Mar. 20, 1984

[54] COAXIAL CABLE TAP

[75] Inventor: Edward A. Bianchi, Hummelstown, Pa.

[73] Assignee: AMP Incorporated, Harrisburg, Pa.

[21] Appl. No.: 373,586

[22] Filed: Apr. 30, 1982

Related U.S. Application Data

[63] Continuation of Ser. No. 139,035, Apr. 10, 1980, abandoned.

[51] Int. Cl.[3] ..... H01R 13/38

[52] U.S. Cl. ..... 339/97 P

[58] Field of Search ..... 339/97 R, 97 P, 99 R, 339/108 TP

[56] References Cited

U.S. PATENT DOCUMENTS

| | | | |
|---|---|---|---|
| 2,694,182 | 11/1954 | Edlen et al. | 339/97 P |
| 2,805,399 | 9/1957 | Leeper | 339/97 P |
| 2,843,827 | 7/1958 | Blonder | 339/97 R |
| 2,906,952 | 9/1959 | Horecky | 339/108 TP |
| 3,461,419 | 8/1969 | Link | 339/97 R |
| 4,120,554 | 10/1978 | Bianchi et al. | 339/97 R |

*Primary Examiner*—Joseph H. McGlynn
*Attorney, Agent, or Firm*—Adrian J. LaRue

[57] ABSTRACT

A coaxial cable tap having two opposed probes, having a stepped profile, comprising a conical forward tip, and a smaller dimensioned axial segment contiguously joined to the base of the conical tip by an integral step. One of the probes is spring loaded and the other is stationary, with the stationary probe achieving the electrical contact, and the spring loaded probe maintaining appropriate counter force upon the cable center conductor.

9 Claims, 7 Drawing Figures

COAXIAL CABLE TAP

This is a continuation, of application Ser. No. 139,035, filed Apr. 10, 1980, now abandoned.

BACKGROUND OF THE INVENTION

1. The Field of the Invention

The present invention relates generally to coaxial connectors. More specifically, the present invention relates to a coaxial cable tap having a pair of opposed probes for penetrating into the coaxial cable, and capturing the center conductor of the cable therebetween.

2. The Prior Art

With the increased presence of data processing machines and their peripherals in the modern office environment, the interconnection of these machines with a high speed telecommunications system is a logical requirement for improving their utility. Consequently, the industry has been in need of the development of such an interconnection system.

Most interconnection concepts employ a single coaxial cable as the data transmission medium. Currently available cables, while capable of carrying megabit per second data rates for hundreds or thousands of feet, cannot be easily tapped. Current practice is to cut the cables and interpose a coupling device wherever a tap is needed. This is a costly operation which requires skilled labor and it necessitates temporary interruption of service.

One alternative is to use a tapping device which pierces the jacket of the cable and establishes the electrical contact without actually cutting the electrical conductors. Such a device is disclosed in U.S. Pat. No. 4,120,554, hereby incorporated by reference. As taught thereby, a center conductor is captured between two probes, one of which being spring loaded and the other being stationary. The stationary probe establishes electrical contact, and the spring loaded probe maintains appropriate forces for ensuring the integrity of the connection over time.

The above patented connector envisions that both probes would be sharp enough to pierce the cable unassisted. While the connector probes of the prior art work well, certain shortcomings prevent them from representing an ideal solution of the industry's needs. Since both probes must pierce the cable shield first, and subsequently engage the center conductor, it is imperative that penetration through the shielding be clean. Presently available probes are profiled such that clean penetration of the cable shield cannot be absolutely guaranteed during the termination procedure, and the cable shield may be undesirably deformed inwardly toward the center conductor. Such a deformation increases the possibility that the cable shield and the center conductor will be electrically commoned, resulting in an ineffective cable tap.

By necessity, the probe must be insulated along an axial length between the conductive center conductor engaging tip and the cable shield. Previous probe embodiments, however, comprised a dielectric body surrounding the conductive probe pin having external dimensional irregularities, and sharp dielectric angles, which prevented clean penetration of the cable shield. Worse yet, the dielectric bodies used with current probes provide an external surface which angles sharply from the conductive tip of the probe. The cable shield can catch upon the dielectric body surface angle and be deformed inward during penetration of the cable by the probe. This results in a proximal spacing between the shield and center conductor of the cable which increases the danger of commoning contact.

Accordingly, the industry has been in need of a center conductor engaging probe which is profiled for clean penetration of the shield of the coaxial cable. Still further, the industry has been in need of a profiled dielectric body for such a probe which effectively functions to insulate the tip of the center conductor probe from the cable shield, yet which does not present any external surface irregularities or angles which can inhibit clean penetration of the cable shield.

SUMMARY OF THE PRESENT INVENTION

A coaxial cable tap is disclosed having two opposed probes which function to capture the center conductor of the cable therebetween. One of the probes is spring loaded and the other is stationary, with the stationary probe achieving the electrical contact, and the spring loaded probe maintaining appropriate counter force upon the cable center conductor. Each probe is adapted having a stepped profile, comprising a conical forward tip, and a smaller dimensioned axial segment portion contiguously joined to the base of the conical tip by an integral step. A dielectric body encases each probe, with a cylindrical sleeve of the body surrounding the smaller dimensioned segment portion of the probe. The outer diameter of the sleeve is generally the same as the base diameter of the conical tip of the probe, whereby the general profile of the probe is streamlined at the forward end for effective penetration through the cable shield. Effective penetration of the cable shield is effectuated since there are no external dielectric body surface irregularities which can catch and influence the cable shield toward contact with the center conductor. Effective electrical isolation between the probe tip and the cable shield results. The rearward end of the probe is further adapted for engagement with further electrical contact means.

Accordingly, it is an objective of the present invention to provide a connector for tapping a coaxial cable.

It is a further objective of the present invention to provide a connector for tapping a coaxial cable featured having a center conductor probe structured to cleanly penetrate through the cable sheath shield and contact the cable center conductor.

Still further, it is an objective of the present invention to provide a connector for tapping a coaxial cable which is featured having a center conductor probe having forward means contacting the cable center conductor and dimensioned rearward means for engaging a further electrical contact.

Yet a further objective of the present invention is to provide a connector for tapping a coaxial cable featured having an insulated center conductor probe which provides a uniform outer dimension at a forward end for streamlined penetration of the cable shield.

Furthermore, it is an objective of the present invention to provide a connector for tapping a coaxial cable featured having an insulated probe profiled for achieving optimal isolation between a center conductor contacting tip of the probe and the cable shield.

Still further, it is an objective of the present invention to provide a connector for tapping a coaxial cable which is economically and readily produced.

These and other objectives, which will become apparent to one skilled in the art, are achieved by preferred embodiment which is described in detail below, and which is illustrated by the accompanying drawings.

BRIEF DESCRIPTION OF THE ACCOMPANYING DRAWINGS

DETAILED DESCRIPTION OF THE PREFERRED EMBODIMENT

Figure 1:
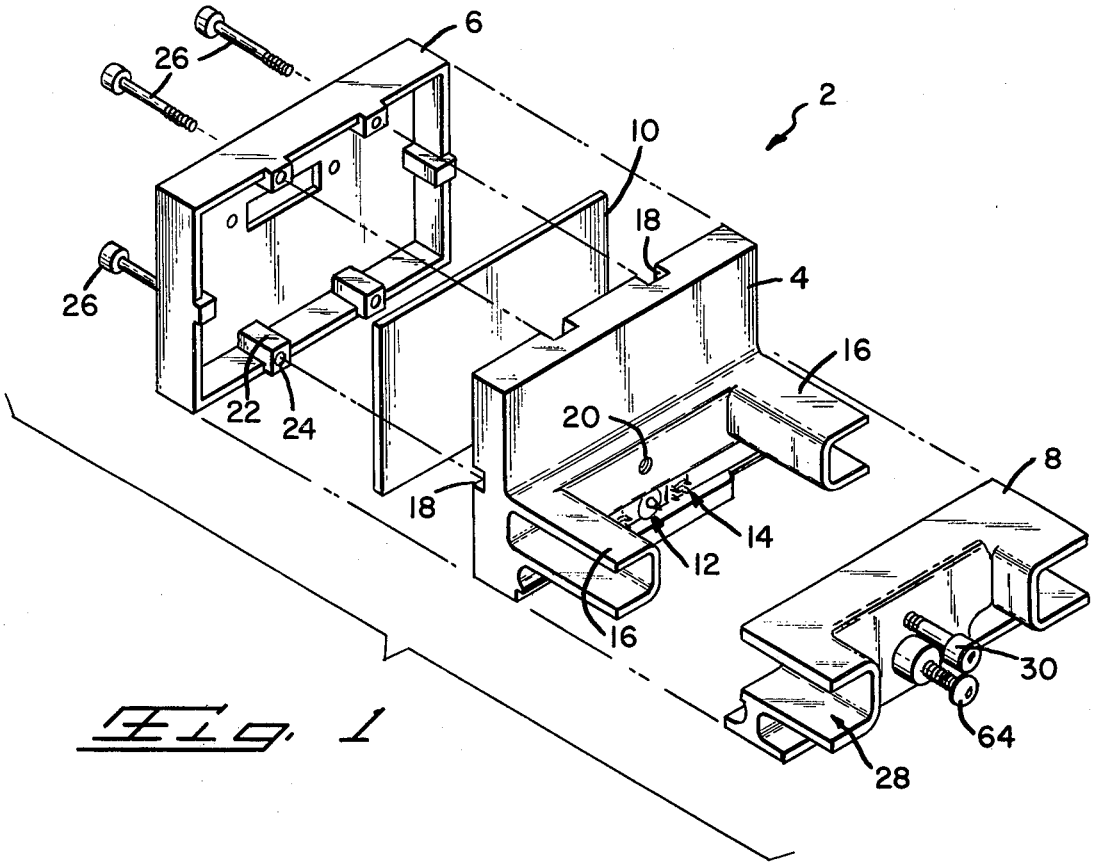
FIG. 1 is an exploded perspective view of the subject coaxial cable tap.

Referring to FIG. 1, the subject coaxial cable tap 2 is shown to comprise a housing block 4, a profiled backplate 6, a profiled front plate 8, and a printed circuit board 10 receivable into a rearward cavity of the housing block 4. A tap of this general type is disclosed in U.S. Pat. No. 4,120,554, incorporated herein by reference.

Mounted into the housing block 4 are an outwardly directed center conductor engaging probe 12 and two braid engaging contacts 14. A pair of inwardly projecting alignment bosses 16 are formed integral with the block 4, and a plurality of assembly slots 18 are provided therein spaced about the rearwardly facing periphery of the block 4. A central aperture 20 extends through the housing block 4 for a purpose explained below.

Figure 2:
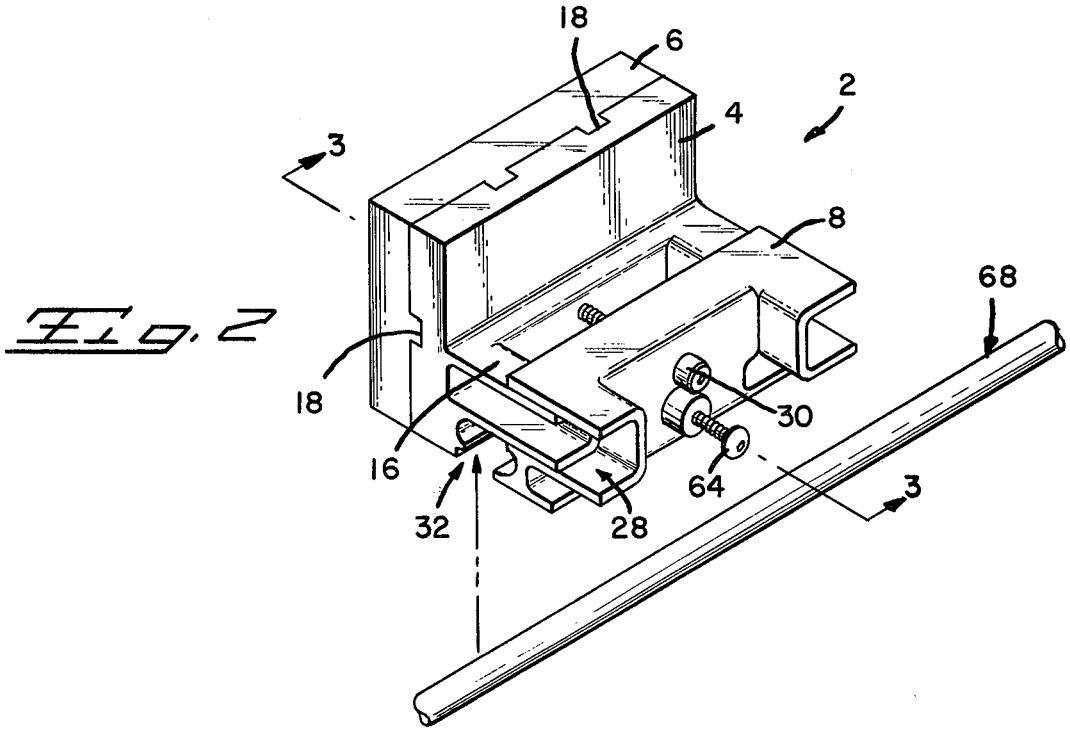
FIG. 2 is an assembled perspective view of the subject coaxial cable tap illustrated in FIG. 1, and having a coaxial cable exploded therefrom.

The front plate 8 is profiled having integral alignment channels 28 for receiving the housing bosses 16 therein. An assembly screw 30 extends through the front plate and is adapted for entry into the housing block aperture 20 to draw the housing block and the front plate together, whereby a cable receiving channel 32 is described by the lower profiled portions of the front plate 8 and the housing block 4 as shown by FIG. 2. The printed circuit board is received into a rearward cavity of the housing block 4, and the back plate 6 is thereafter secured to the housing block by assembly screws 26.

Figure 3:
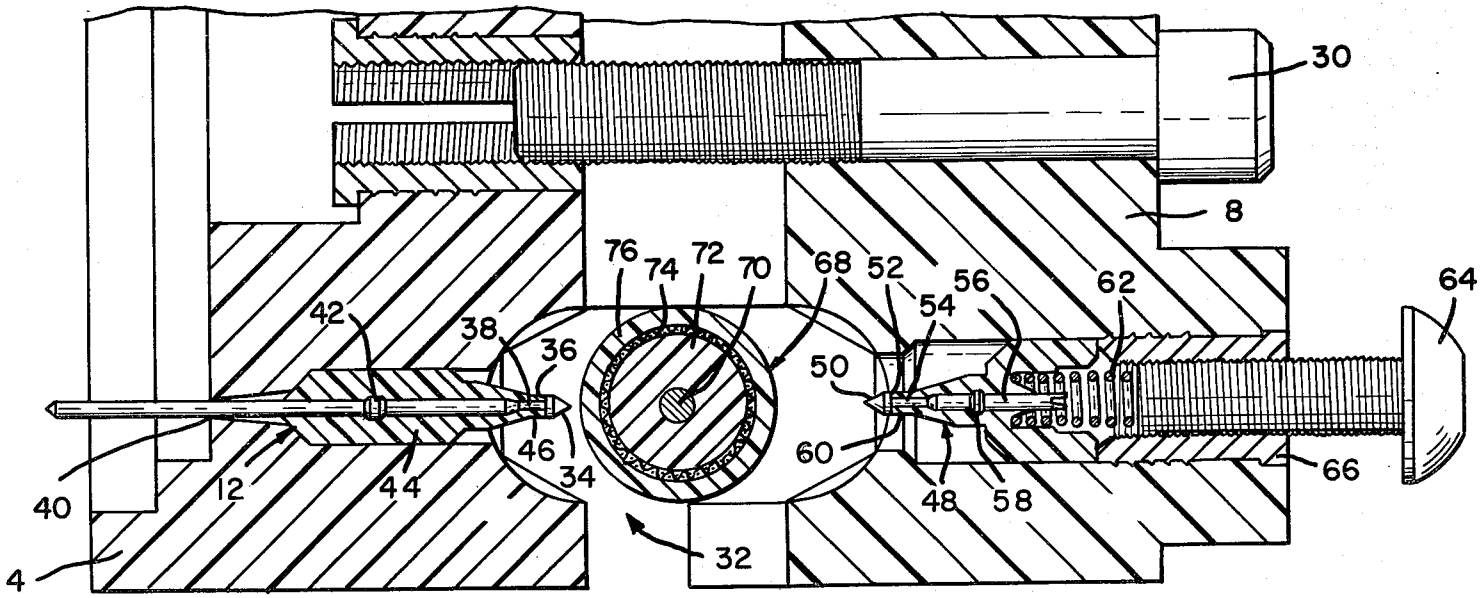
FIG. 3 is a longitudinal section view through the subject coaxial cable tap of FIG. 2 at an intermediate stage in the assembly procedure.

Referring now to FIG. 3 illustrating the housing block 4 and the front plate 8 in a partially assembled condition, the center conductor probe 12 comprises a conical nose portion 34, a smaller diameter axial segment 38 contiguously joined to the base of conical portion 34 by an integral step 36, and a rearward length 40 having an annular retention flange 42 positioned intermediate the axial length thereof. The diameter of the rearward axial length 40 is selected for insertion through the printed circuit board 10 (FIG. 1) for electrical interconnection therewith, and it will be appreciated that the diametric size of the rearward axial length 40 can be varied independent of the diametric dimensions of the axial segment 38, and the dimensions of the conical portion 34.

A dielectric body 44 is molded to the rearward axial length 40 of the probe, and is formed to generally taper forward toward the nose portion 34 of the probe. The dielectric body 44 thereby continuously insulates the axial length of the probe forward to the base of the conical nose 34. A forward cylindrical sleeve 46 of the dielectric body 44 is formed to surround the smaller diametered axial segment 38, and abuts against the integral step 36. The outer diameter of the cylindrical sleeve 46 is formed substantially the same as the base diameter of the conical nose portion 34, whereby the overall profile of the forward end of the insulated probe is streamlined and regular.

A backup probe 48 is mounted within the front plate 8, and comprises a conical forward nose portion 50, a smaller diametered axial segment 54 joined to the nose portion 50 by an integral step 52, and a rearward axial length 56 having an annular flange 58 positioned intermediate the axial length thereof. A dielectric body insulates the backup probe, and includes a cylindrical sleeve 60 which surrounds the smaller axial segment 54 of the probe in the same manner as described above for the primary probe 12. The backup probe 48 is spring loaded into the front cover by means of a helical spring 62, and a setscrew which threads into a bushing 66.

A coaxial cable 68 is shown positioned within the passageway 32 defined by the housing block 4 and the front plate 8, and is structured to comprise a center conductor 70 surrounded by a dielectric layer 72, a braided shield 74, and an outer sheath 76.

Figure 4:
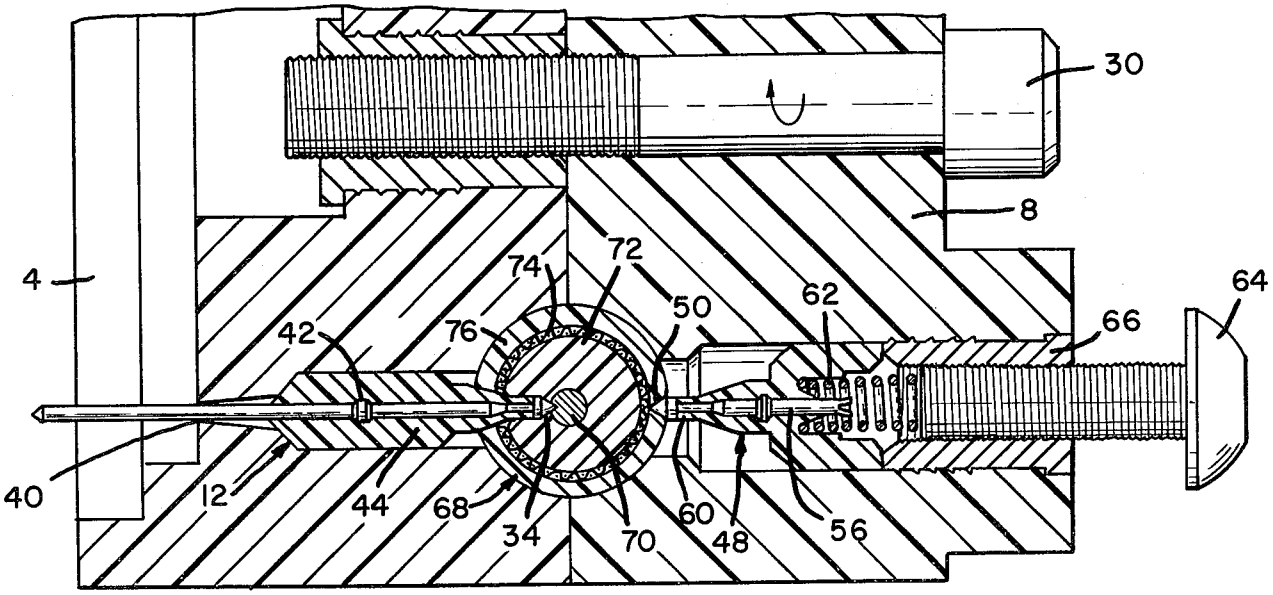
FIG. 4 is a longitudinal section view through the subject coaxial cable tap illustrated in FIG. 2 at a point in the assembly procedure where the stationary probe contacts the cable center conductor.
Figure 5:
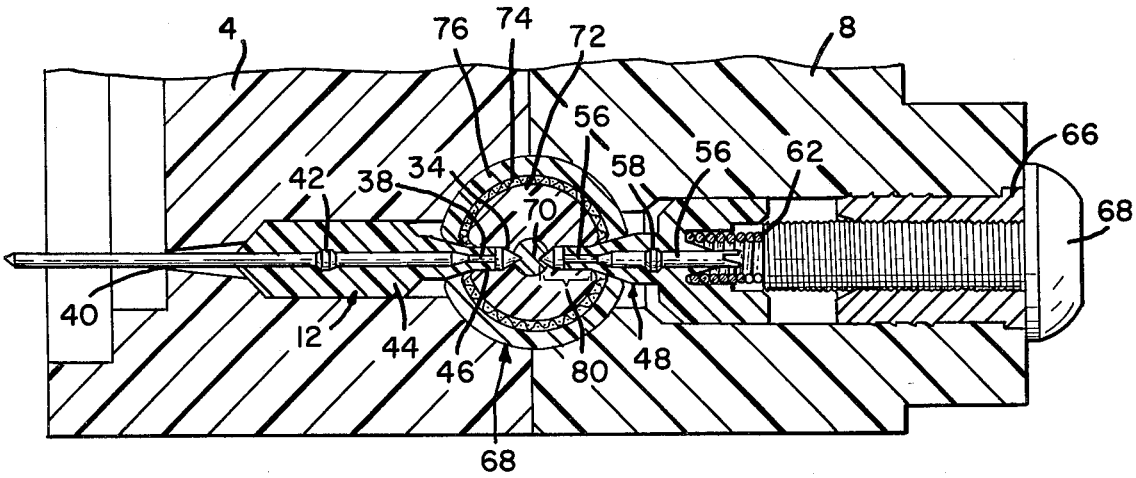
FIG. 5 is a longitudinal section view through the subject coaxial cable tap illustrated in FIG. 2, at a point in the assembly procedure where the spring loaded probe is brought into contact against the cable center conductor.
Figure 6:
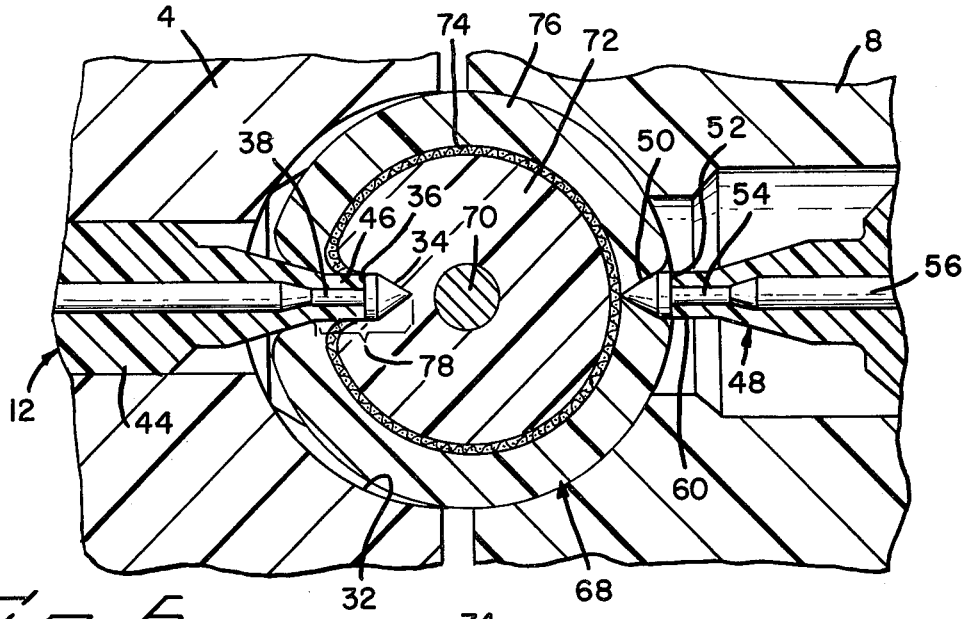
FIG. 6 is an enlarged longitudinal section view through the subject coaxial cable tap, illustrating penetration of the stationary probe through the coaxial cable shield.

Referring to FIGS. 4 and 5, as the housing block 4 and the front plate 8 are influenced towards each other by inward adjustment of the assembly screw 30, the center conductor engaging probe 12 pierces through the cable sheath 76 and penetrates into the braided shield 74. Clean penetration is assured since the outer surface of the probe from the conical nose 34 along the dielectric sleeve 46 is regular and without any sharp surface angles on which the shield cover could snag. The punctured cable shielding therefore smoothly rides along the dielectric sleeve 46 as the inwardly directed conical nose 34 of the probe progresses toward the center conductor 70 of the cable. The regular surfaces along the probe profile, each described above, is indicated numerically as 78 in FIG. 6.

Continuing, the assembly screw 30 is further inwardly adjusted as shown by FIG. 4 to bring the housing block 4 and the front plate 8 into a final assembled abuttment. Simultaneously therewith, the center conductor probe 12 progresses deeper into the cable and into embedding engagement with the center conductor 70. Subsequently, an inward adjustment of the set screw 64 influences the backup probe 48 into the cable and into a reinforcing contact with the center conductor 70. FIG. 5 illustrates that the primary probe 12 and the backup probe 48 contact opposite points of the conductor. It will be appreciated that the resilient force exerted on the center conductor by the spring loaded backup probe 48 serves to ensure good electrical contact between the primary probe 12 and the center conductor 70.

It will be apparent that the outer surface of the forward end of the backup probe, which is indicated at numeral 80 of FIG. 5, is profiled identically with the axial length 78 of the primary probe 12. Thus, the backup probe conical portion 50 is effectively electrically isolated by the dielectric sleeve 60, and yet the probe is streamlined for clean penetration of the cable shield. Note that the backup probe tip 50 is of a metallic composition. While this results in some degradation in the performance of the coaxial tap, the hardness of the metallic tip is considered desirable in preserving a good resilient force against the center conductor of the cable. Other non-conductive, but hard materials, however, may be substituted in the formation of the backup probe if so desired.

Figure 7:
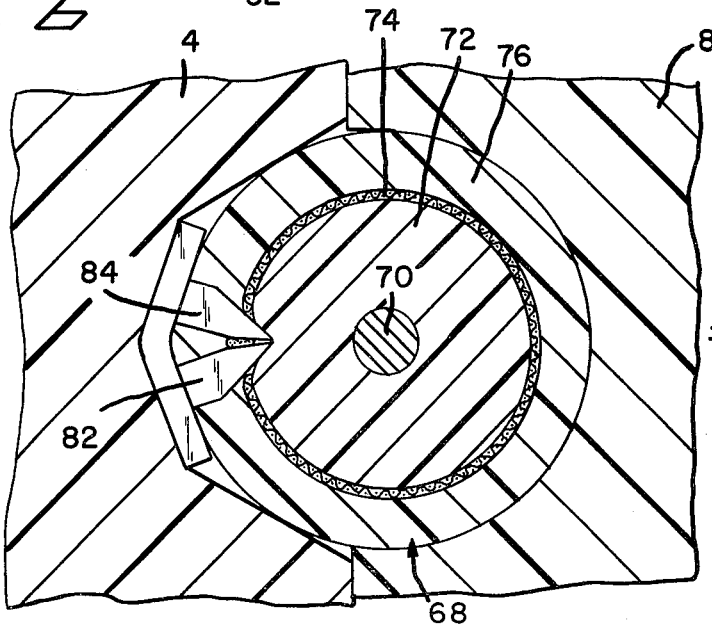
FIG. 7 is a longitudinal section view through the subject coaxial cable tap, illustrating contacting engagement between shield contacts of the cable tap and the outer shield of the coaxial cable.

As shown by FIG. 7, and described in detail in the incorporated U.S. Pat. No. 4,120,554, the cable braid 74 is electrically engaged by the contact 14. The contact 14 comprises a pair of barbs 82, 84, which are directed from a mutual parallel relationship to a convergent relationship upon assembly of the housing block 4 against the front plate 8. The barbs 82, 84, are thereby inwardly directed to pinch a portion of the braided shield 74 therebetween, and establish electrical contact therewith.

While the above description of the preferred embodiment exemplifies the principles of the subject invention, other embodiments which would be apparent to one skilled in the art and which utilize the teachings herein set forth are intended to be within the scope and spirit of the subject invention.

What is claimed is:

1. A coaxial cable connector for connection with a coaxial cable having a center conductor, insulation sheath surrounding the center conductor, an outer conductor extending along the insulation sheath and an outer insulating jacket covering the outer conductor, said coaxial cable connector comprising:

first and second matable housing means having channel means along which a section of the coaxial cable is to be disposed;

first probe means mounted in said first housing means and second probe means mounted in said second housing means;

said first and second probe means having conductive means secured in dielectric means defining cable-penetrating means, said conductive means having conical portion means, axial segment means, and base means contiguously joining said axial segment means and said conical portion means, said axial segment means having a diameter therealong less than said base means, said dielectric means secured on said axial segment means extending rearwardly from said base means and having first and second section means, said first section means having an outer diameter substantially the same as the diameter of said base means and said second section means having a tapered outer surface;

said first probe means stationarily mounted in an opening in said first housing means with said cable-penetrating means extending into the channel means thereof;

said second probe means movably mounted in an opening in said second housing means with cable-penetrating means normally disposed within the opening and out of the channel means;

first operating means connected between said first and second housing means to move said housing means together with the section of the cable in said channel means causing said cable-penetrating means of said first probe means to penetrate through the outer insulating jacket, the outer conductor, within the insulation sheath with the conical portion means electrically connected to the center conductor during the mating of said housing means together, said first section means of said dielectric means being disposed in the insulation sheath while the second section means engages the outer conductor and outer insulating jacket thereby insulating the conductive means of said first probe means in connection with the center conductor from the outer conductor; and second operating means connected to said second probe means for moving said second probe means along the opening in said second housing means after the housing means have been mated together causing the cable-penetrating means of said second probe means to penetrate through the outer insulating jacket, the outer conductor, within the insulation sheath with the conical portion means engaging the center conductor, said first section means of said dielectric means being disposed in the insulation sheath while the second section means engages the outer conductor and outer insulating jacket thereby insulating the conductive means of the second probe means in connection with the center conductor from the outer conductor.

2. A coaxial cable connector as set forth in claim 1 and further comprising contact means in one of said first and second housing means for penetrating the outer insulating jacket of the coaxial cable and make electrical connection with the outer conductor.

3. A coaxial cable connector as set forth in claim 1 wherein said first and second conductive probe means are in alignment.

4. A coaxial cable connector as set forth in claim 1 wherein said second operating means includes spring means which exerts a spring force onto said second probe means and the center conductor to ensure good electrical contact between said first probe means and the center conductor.

5. A coaxial connector as set forth in claim 1, wherein alignment means are located on said housing means to maintain them in alignment during their mating together.

6. A coaxial cable connector comprising:

first and second matable housing means comprising means for retaining a coaxial cable having a center conductor and an outer conductor separated by insulation sheath means and an outer insulating jacket in a predetermined position within said housing means as said first and second housing means are mated;

center conductor probe means having conductive means secured in dielectric means defining cable-penetrating means, said conductive means comprising a forwardly-directed conical portion, an axial segment and base means contiguously joining said axial segment and said conical portion, said axial segment having a diameter therealong less than said base means; and said dielectric means secured on said axial segment extending rearwardly from said base means and having first and second section means, said first section means having an outer diameter substantially the same as the diameter of said base means and said second section means having an outer tapered surface, said cable-penetrating means of said probe means adapted to penetrate through the outer insulating jacket, outer conductor and within the insulation sheath means as said first and second housing means are mated so that said conical portion makes electrical connection with the center conductor of the coaxial cable and said first section means of said dielectric means is disposed in the insulation sheath means while the second section means engages the outer conductor and the outer insulating jacket thereby insulating the conductive means of said probe means in connection with the center conductor from the outer conductor.

7. A coaxial cable connector as set forth in claim 6, further comprising contact means positioned in one of said first and second housing means to penetrate and make contact with the outer conductor.

8. A coaxial cable connector as set forth in claim 6, further comprising a spring-loaded backup probe means positioned in said second housing means for penetrating into said coaxial cable and pressing against the center conductor thereof at a point opposite said center conductor probe means, said backup probe means having conductive member means and dielectric member means defining cable member-penetrating means, said conductive member means comprising a forwardly-directed conical section, an axial section and base member means contiguously joining said axial section and said conical section, said axial section having a diameter therealong less than said base member means; and said dielectric member means secured on said axial section extending rearwardly from said base member means and having first and second portion means, said first portion means having an outer diameter substantially the same as the diameter of said base member means and said second portion means having an outer tapered surface, said cable member-penetrating means adapted to penetrate through the outer insulating jacket, outer conductor and within the insulation sheath means so that said conical section engages the center conductor of the coaxial cable and said first portion means of said dielectric means is disposed in the insulation sheath means while the second portion means engages the outer conductor and the outer insulating jacket.

9. A profiled electrical probe for penetrating through an outer insulating jacket, an outer conductor, into an insulation sheath and electrically connecting with a center conductor of a coaxial cable, said probe comprising:

a conductive member having a conical portion, an axial segment and a base of said conical portion contiguously joining said conical portion and said axial segment together, said axial segment having a diameter smaller than said base;

dielectric means secured onto said axial segment and including a first section and a second section, said first section having an outer diameter substantially the same as that of said base for disposition in the insulation sheath and said second section having a tapered outer surface for engagement with the outer insulating jacket and the outer conductor when said probe penetrates into the cable through the outer insulating jacket and the outer conductor, said dielectric means insulating the connection of the conductive member with the center conductor from the outer conductor.

* * * * *

UNITED STATES PATENT OFFICE

CERTIFICATE OF CORRECTION

Patent No. 4437722 Dated March 20, 1984

Inventor(s) Edward Armond Bianchi

It is certified that error appears in the above-identified patent and that said Letters Patent are hereby corrected as shown below:

Column 5, line 64, claim 1, after the word "with" add said

Signed and Sealed this

*Nineteenth* Day of *June 1984*

[SEAL]

*Attest:*

GERALD J. MOSSINGHOFF

*Attesting Officer* *Commissioner of Patents and Trademarks*